US009863715B2

(12) United States Patent
Gruener et al.

(10) Patent No.: US 9,863,715 B2
(45) Date of Patent: Jan. 9, 2018

(54) PLATE HEAT EXCHANGER WITH FLANGED BASE OR CONNECTING PLATE

(75) Inventors: Andreas Gruener, Hattenhofen (DE); Clemens Schupp, Gerlingen (DE)

(73) Assignee: Mahle International GmbH (DE)

( * ) Notice: Subject to any disclaimer, the term of this patent is extended or adjusted under 35 U.S.C. 154(b) by 301 days.

(21) Appl. No.: 14/238,199

(22) PCT Filed: Jul. 27, 2012

(86) PCT No.: PCT/EP2012/064759

§ 371 (c)(1),
(2), (4) Date: Jun. 3, 2014

(87) PCT Pub. No.: WO2013/020828

PCT Pub. Date: Feb. 14, 2013

(65) Prior Publication Data

US 2014/0311722 A1 Oct. 23, 2014

(30) Foreign Application Priority Data

Aug. 11, 2011 (DE) ..... 10 2011 080 828

(51) Int. Cl.

| | |
|---|---|
| ***F28F 3/08*** | (2006.01) |
| ***F28F 9/02*** | (2006.01) |
| ***F28D 9/00*** | (2006.01) |

(52) U.S. Cl.

CPC ..... *F28F 3/08* (2013.01); *F28D 9/005* (2013.01); *F28F 9/02* (2013.01)

(58) Field of Classification Search

CPC ..... F28F 2225/00; F28F 2225/02; F28F 2225/04; F28F 3/08; F28F 9/02; F28D 9/005

See application file for complete search history.

(56) References Cited

U.S. PATENT DOCUMENTS 5,685,368 A * 11/1997 Yuasa ..... B01D 35/18 165/167
2004/0112579 A1* 6/2004 Strahle ..... F28D 9/005 165/166

(Continued)

FOREIGN PATENT DOCUMENTS

AT WO 2011006825 A2 * 1/2011 ..... F28D 9/005
DE 102004003790 A1 8/2005

(Continued)

OTHER PUBLICATIONS

English abstract for DE102009030095.

(Continued)

*Primary Examiner* — Davis Hwu
*Assistant Examiner* — Gordon Jones
(74) *Attorney, Agent, or Firm* — Fishman Stewart PLLC

(57) ABSTRACT

A plate heat exchanger may include a plurality of stacked plates, each formed of flat troughs fitted into each other having substantially flat bottoms and connected at respective trough edges. The plurality of plates may separate first and second chambers from one another which are arranged alternately succeeding within the plate stack formed by the troughs. A first fluid may flow in parallel through the first chambers connected in parallel via associated openings in the plates, and a second fluid flow may flow in parallel through the second chambers connected in parallel via associated second openings. The plate heat exchanger may include a base plate for holding an end face of the plate stack. The base plate may be arranged on the end face of the plate stack, the end face formed by a convex side of a plate. The plate heat exchanger may include a flange.

13 Claims, 4 Drawing Sheets

(56) References Cited

U.S. PATENT DOCUMENTS

| | | | | |
|---|---|---|---|---|
| 2007/0084809 | A1 | 4/2007 | Bradu et al. | |
| 2007/0289724 | A1 | 12/2007 | Hoof et al. | |
| 2008/0257536 | A1 | 10/2008 | Kolblin et al. | |
| 2011/0024095 | A1 | 2/2011 | Kozdras et al. | |
| 2012/0175092 | A1* | 7/2012 | Otahal | F28D 9/005 165/166 |

FOREIGN PATENT DOCUMENTS

| | | | |
|---|---|---|---|
| DE | 102009030095 | A1 | 12/2010 |
| DE | 102010001828 | A1 | 8/2011 |
| EP | 0623798 | A2 | 11/1994 |
| EP | 1562014 | A1 | 8/2005 |
| EP | 1801407 | A1 | 6/2007 |
| EP | 1855074 | A2 | 11/2007 |
| EP | 1925899 | A2 | 5/2008 |
| EP | 2267390 | A2 | 12/2010 |
| JP | H02-089991 | A | 3/1990 |
| WO | WO-2007038871 | A1 | 4/2007 |
| WO | WO-2011/006825 | A2 | 1/2011 |
| WO | WO-2011/011861 | A1 | 2/2011 |

OTHER PUBLICATIONS

English abstract for DE-102010001828.
English abstract EP-0623798.
English abstract EP-1925899.
English abstract EP-2267390.
Japanese Office Action translation, Patent Application No. 2014-525383, dated Apr. 19, 2016.

* cited by examiner

PLATE HEAT EXCHANGER WITH FLANGED BASE OR CONNECTING PLATE

CROSS-REFERENCE TO RELATED APPLICATIONS

This application claims priority to German Patent Application Number 10 2011 080 828.0, filed Aug. 11, 2011, and International Patent Application No. PCT/EP2012/064710, filed Jul. 27, 2012, both of which are hereby incorporated by reference in their entirety.

TECHNICAL FIELD

The invention relates to a plate heat exchanger, in particular for water and oil, comprising a multiplicity of stacked plates, each of which are formed in the form of flat troughs which are fitted into each other and have substantially flat bottoms and are tightly connected to each other at their trough edges, and which separate first and second chambers from one another which are arranged alternately succeeding within the plate stack formed by said troughs, wherein a first fluid (e.g. water) can flow in parallel through the first chambers which are connected to one another in parallel via associated openings in the plates, and a second fluid (e.g. oil) can flow in parallel through the second chambers which are connected to one another in parallel via associated second openings, and comprising a base plate or connecting plate provided for holding the heat exchanger on one end face of the plate stack.

BACKGROUND

Such plate heat exchangers are generally known. Reference is made to DE 10 2009 030 095 A1, EP 0 623 798 A2 and EP 1 562 014 A1 as examples.

Such plate heat exchangers are typically used as oil cooler in motor vehicles, i.e., the oil to be cooled flows through the one chambers and the cooling water serving as cooling medium flows through the other chambers. With regard to good efficiency it is usually provided here that the fluids subjected to heat exchange are let flow in opposite flow directions in order to implement a heat exchange according to the counterflow principle. Alternatively, a so-called cross-flow construction is also known in which the flow paths of the two flows cross each other diagonally in such a manner that the flow paths have great oppositely directed directional components.

Further plate heat exchangers are known, for example, from DE 10 2004 003 790 A1, DE 10 2010 001 828 A1, WO 2007/038871 A1, WO 2011/006825 A2 and WO 2011/011861 A1.

When used as an oil cooler of an internal combustion engine, the heat exchanger is usually held on stable parts of the engine housing, wherein in this case, load through engine vibrations becomes unavoidable.

In addition, loads caused by changing temperatures occur, which result to a lesser or greater extent in tensioning between adjacent plates. Since the trend in development of internal combustion engines currently and in the futures will go in the direction of internal combustion engines with small cubic capacity and a comparatively low number of cylinders, there is also a tendency towards increasing loads caused by temperature changes and vibrations.

In previous plate heat exchangers, the base plate or connecting plate was formed comparatively thick-walled and heavy and also extremely stiff, e.g., as a stamping.

Nevertheless, after a certain operating time of the heat exchanger, cracks occurred in the connection region between the plate stack and the base or connecting plate so that it was not possible to achieve an operating time that matches the lifespan of the respective combustion engine.

This is where the invention starts, wherein a simple and light-weight construction is the aim.

SUMMARY

It is an object of the invention to provide a construction that is durably secure with respect to vibrations and temperature changes.

This object is achieved according to the invention with a plate heat exchanger of the aforementioned kind in that the base or connecting plate is arranged on the plate stack's end face which is formed by the convex side of a plate, and is made from flat material that is shaped by forming, thereby forming a receptacle that rests in a frame-like manner against the bottom edge and/or trough edge of the plate at the end face, and also forming a flange that surrounds the plate stack. The flange of the base or connecting plate is circumferentially bent/angled both at its inner edge at the stack and at its free outer edge, wherein fastening holes provided on the flange are arranged between the two circumferential angled portions. In the further description, the term "flange" is of course also to be understood as a flange surface or a flange plate.

The invention is based on the general idea of providing the base plate or connecting plate with a comparatively thin wall and with a receiving frame which rests in a form-fitting manner against the bottom edge and/or trough edge. This ensures optimal adaptation to the shape of the plate stack and a large-area contact of the base plate or connecting plate on the plate stack.

It is in particular advantageous that the base or connecting plate supports the heat exchanger over a large area, and accordingly, all connections, in particular solder connections or the like, between the heat exchanger and the base or connecting plate are comparatively lightly loaded.

All these advantages are implemented to a particularly high degree if the base or connecting plate according to a preferred embodiment of the invention forms with its receptacle a bed that is clung to the bottom edge or trough edge of the plate at the end face. In a configuration that is particularly simple in terms of manufacturing, the base or connecting plate can be designed as an integral moulded part, wherein the flange transitions at its inner edge into the receptacle or the bed, and at its outer edge, it can be bent according to another advantageous configuration of the invention.

According to another advantageous embodiment of the invention, the base or connecting plate can also be composed of two parts or multiple parts, i.e., as an assembled part. In particular, a double-layered or multi-layered flange can be provided here.

According to an advantageous configuration of this construction, a ring-shaped blank of a flat material serving for forming the double layer can be bent at its inner marginal zone so as to form a wall that rests against the trough edge of the plate at the end face of the plate stack.

Moreover, the outer edge of the aforementioned flat material can also be bent so that a particularly stiff profile is formed.

Furthermore, with regard to preferred features of the invention, reference is made to the claims and the following explanation of the drawing based on which particularly preferred embodiments are described in greater detail.

Protection is claimed not only for specified or illustrated feature combinations, but also for principally any combinations of the specified or illustrated individual features.

DETAILED DESCRIPTION

Figure 1:
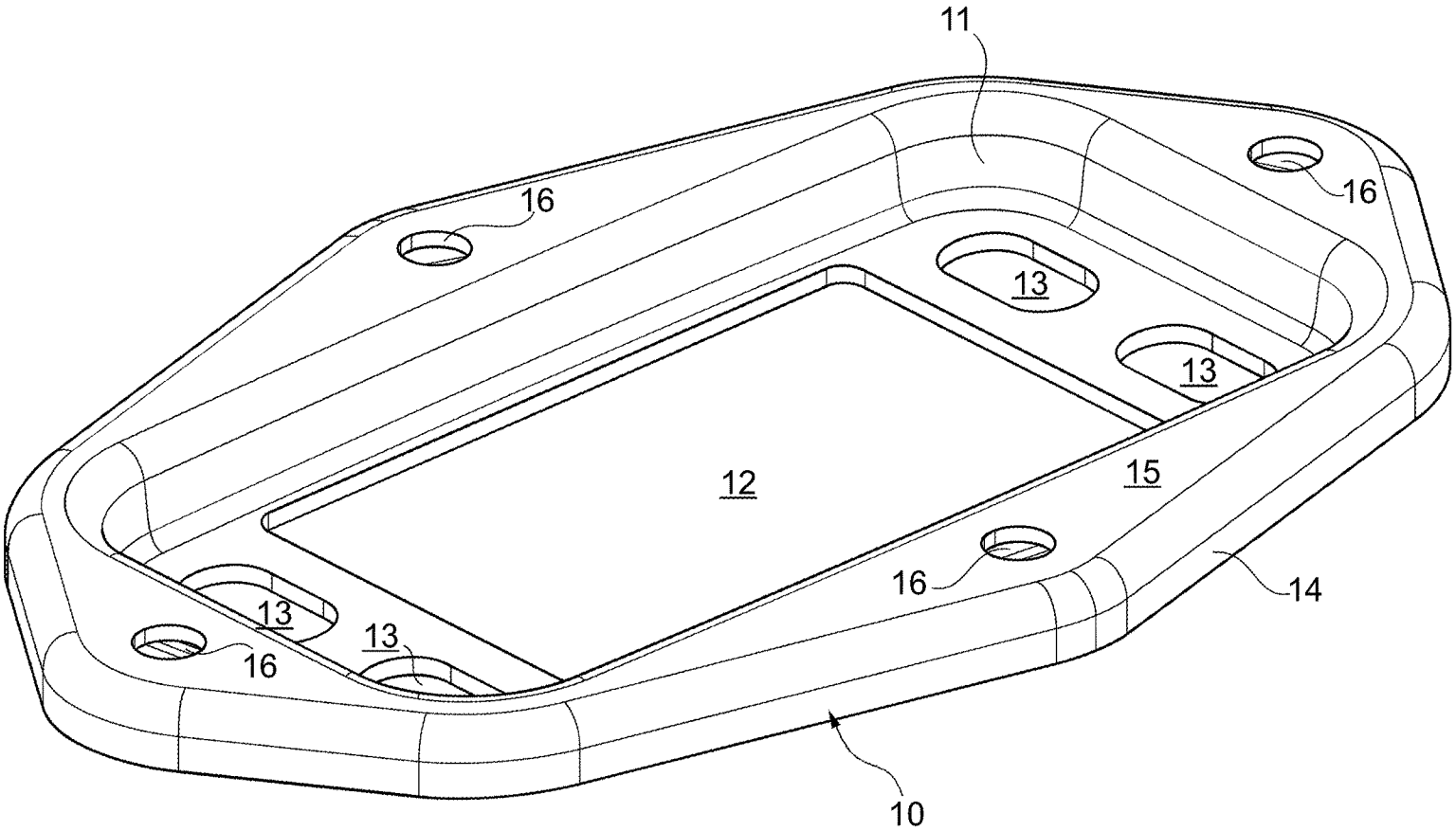
FIG. 1 shows a perspective top view onto the base or connecting plate.

The base or connecting plate 10 illustrated in FIG. 1 consists of a flat material, for example a sheet metal, preferably an aluminium or stainless steel sheet, which is formed according to the drawing. As illustrated, the base or connecting plate 10 has a bed 11 that is moulded therein, and the shape of which is adapted to the shape of the plate heat exchanger to be received, as will become clear below. Within the bottom of the bed, a large rectangular recess 12 is provided which helps to save weight. Moreover, openings 13 for the fluid connections of the plate heat exchanger are arranged in the bottom area of the bed 11. The bed 11 is surrounded by a flange surface 15 which is provided with a downwardly bent edge 14 for stiffening. The flange surface 15 is circumferentially bent/angled both at its inner edge at the stack and its free outer edge, wherein fastening holes 16 provided on the flange are arranged between the two circumferential angled portions. Furthermore, the flange surface 15 is significantly stiffened due to the fact that it forms together with the edge areas of the bed 11 an angle profile that frames the bed 11. In plan view, the flange surface 15 has the shape of an elongated octagon so that comparatively wide flange surface areas are available at the fastening holes 16. The base or connecting plate 10 illustrated in FIG. 1 can be shaped in a simple manner from sheet metal or any other flat material by pressing, stamping or deep-drawing. A plate from a sufficiently heat-resistant and formable material, which can be reinforced by fibres, is optionally also suitable as flat material. Forming such a workpiece can be carried out in a manner similar to forming sheet metal.

Figure 2:
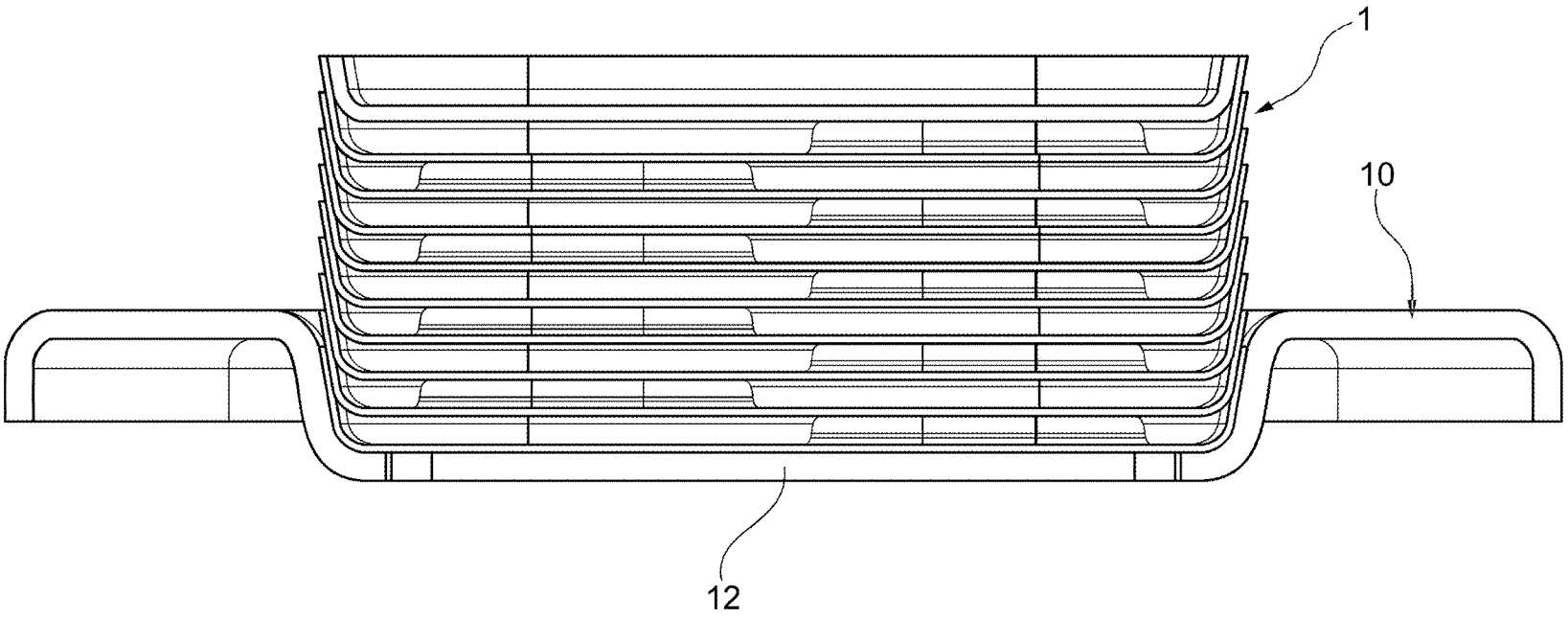
FIG. 2 shows a longitudinal section of this base or connecting plate with the plate heat exchanger inserted.

FIG. 2 shows the base or connecting plate 10 in combination with a plate heat exchanger 1. The latter consists in a principally known manner of plates 2 in the form of flat troughs stacked on top of each other, which have substantially flat bottoms. Between in each case two plates, a layered flow space remains for a fluid, e.g., water or oil. The plates 2 are shaped and formed such that when assembling the plates 2 so as to form a stack, first and second flow spaces are formed, each of which are individually connected in parallel, wherein the first and second flow spaces are arranged alternately succeeding one another within the plate stack. Thus, in the case of an oil-water heat exchanger, a flow space through which oil flows is in each case arranged directly adjacent to a flow space through which water flows. At the uppermost or lowermost plate 2 of the heat exchanger 1, connection lines (not illustrated) for feeding and discharging the two fluids are fitted or can be fitted.

FIG. 2 shows that the bed 11 (compare FIG. 1) is adapted to the convex side of the lowermost plate 2 of the plate heat exchanger 1 in the illustration of FIG. 2, and accordingly clings to the marginal zones of the bottom and the trough edge of this plate.

This fixation of the plate can be carried out in a principally known manner by soldering or welding the edge of the recess 12 (compare FIG. 1) to the bottom of the lowermost plate 2 of the plate heat exchanger 1. Furthermore, the above-mentioned connection lines (not illustrated) of the plate heat exchanger 1 can also serve for or assist in anchoring or fixing the plate heat exchanger 1 to the openings 13 illustrated in FIG. 1.

Figure 3:
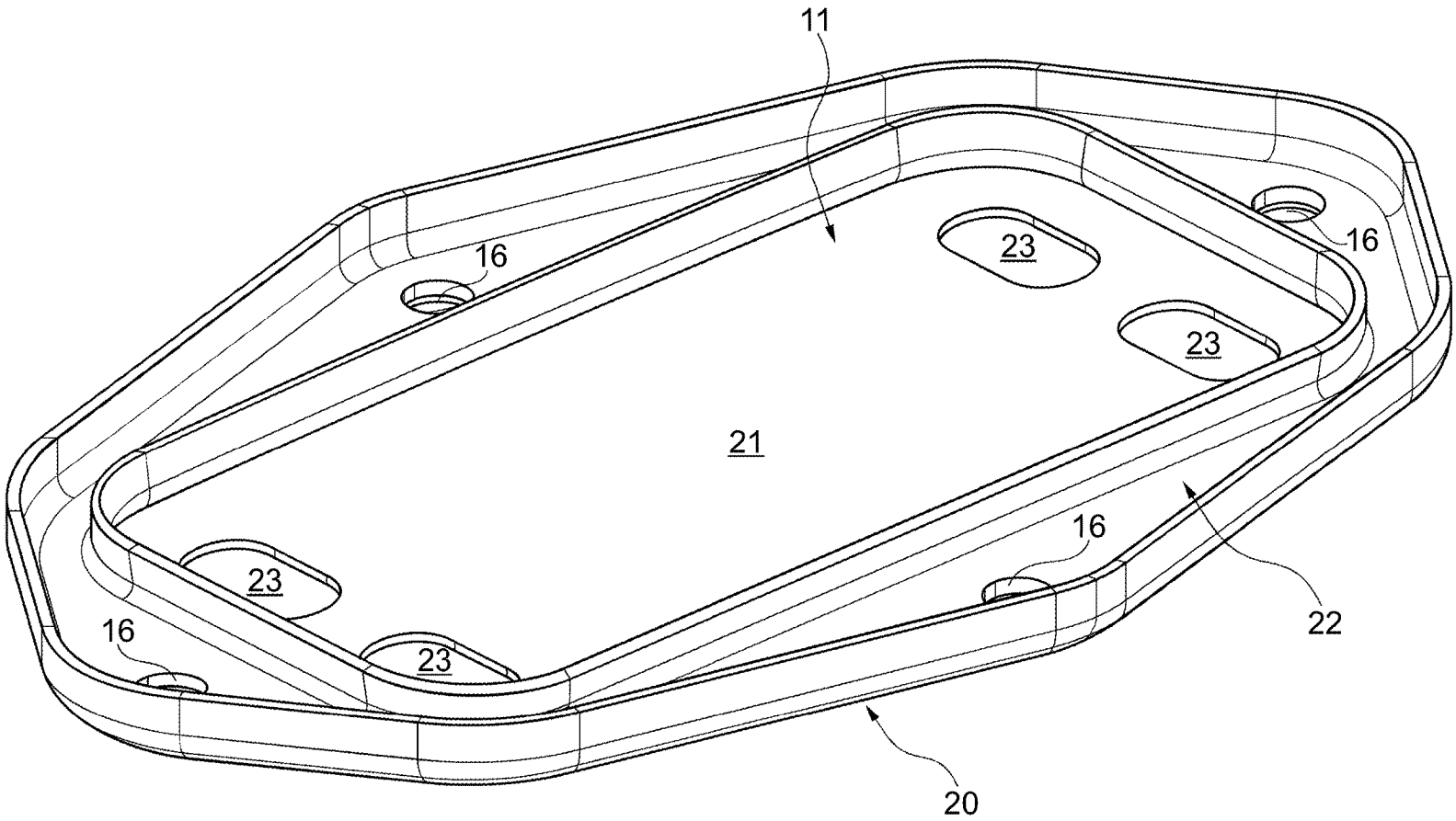
FIG. 3 shows a perspective view corresponding to FIG. 1 of a base or connecting plate according to a modified embodiment.
Figure 4:
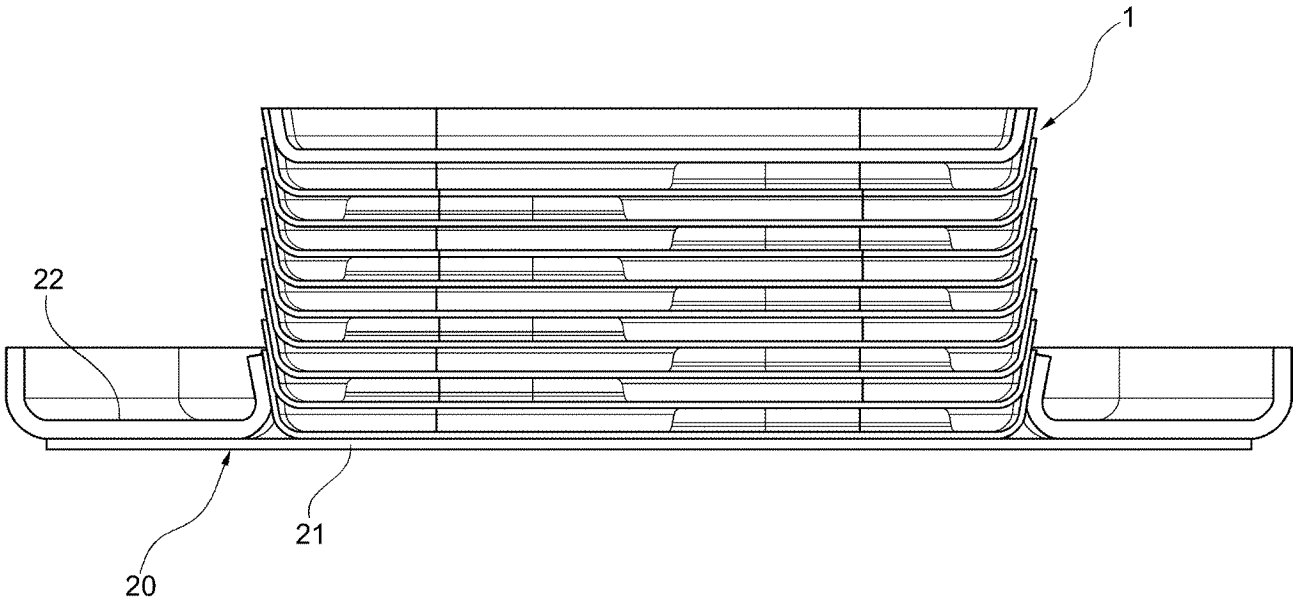
FIG. 4 shows a longitudinal section of this base or connecting plate with the plate heat exchanger inserted.

In the embodiment illustrated in the FIGS. 3 and 4, an assembled base or connecting plate 20 is provided. The latter consists of a flat plate 21 that has the shape of an elongated octagon. On top of a marginal zone of this plate 21, a ring-shaped flange 22 is arranged which is provided with an upwardly bent outer edge and an upwardly bent inner edge. The flange 22 on the base or connecting plate 20 is therefore circumferentially bent/angled at its inner edge on the stack side and also at its outer free edge, wherein fastening holes 16 provided on the flange 22 are arranged between the two circumferential angled portions. The outer edge is adapted to the octagonal shape of the plate 21, and the inner edge has a rectangular shape corresponding to the plan view of the plate heat exchanger 1 to be received by the base or connecting plate. In the example of FIG. 3, the bed 11 provided for receiving the plate heat exchanger 1 is formed by the upwardly bent inner edge of the flange plate 22 and the central region of the plate 21 extending within said inner edge. Here, openings 23 corresponding to the openings 13 in FIG. 1 are provided in the plate 21 for connection lines of the heat exchanger 1.

Moreover, the flange 15, 22 can form a U-profile with a U-basis which receives fastening holes 16 and which has in each case a maximum width at the fastening holes 16.

FIG. 4 shows the combination of the base or connecting plate 20 with the plate heat exchanger 1. In particular, it can be seen that the upwardly bent inner edge of the flange plate 22 is adapted to the inclination of the trough edge of the lowermost plate of the plate heat exchanger and accordingly clings to the trough wall.

In the illustrated embodiments of the base or connecting plate 10 or 20, respectively, the shaping thereof ensures high stability even when manufactured from thin-walled flat material. This is in particular achieved due to the fact that the flange surface 15 in FIG. 1 forms with the downwardly bent outer edge and the transition to the bed 11 a profile similar to a half-pipe. Accordingly, the flange plate 22 with its upwardly bent inner and outer edges likewise has a profile similar to a half-pipe.

Contrary to the illustration of FIG. 3, an opening corresponding to the recess 12 in FIG. 1 could be provided in the central region of the plate 21.

The invention claimed is:

1. A plate heat exchanger, comprising:

a plurality of stacked plates, each formed of flat troughs fitted into each other having substantially flat bottoms and connected at respective trough edges, the plurality of plates separating first and second chambers from one another arranged alternately succeeding within the plate stack formed by said troughs, wherein a first fluid flows in parallel through the first chambers connected in parallel via associated openings in the plates, and a second fluid flows in parallel through the second chambers connected in parallel via associated second openings;

a base plate for holding an end face of the plate stack, the base plate arranged on the end face of the plate stack defined by a convex side of a plate, wherein the base plate is a formed shaped sheet material providing a receptacle for the plurality of plates, the receptacle having a bed that rests against at least one of a bottom edge and a trough edge of the plate at the end face; and a flange surrounding the bed and having a flange surface circumferentially bent at an inner edge facing towards the plate stack and at a free outer edge, wherein the flange has a U-shaped cross section defined by the inner edge and the free outer edge extending at an angle away from the flange surface, and wherein the flange includes fastening holes disposed in the flange surface between the inner edge and the free outer edge;

wherein the inner edge defines a wall surface facing towards the receptacle and mounted against the trough edge of the plate at the end face of the plate stack; and wherein the flange surface having the fastening holes lies on a plane that is elevated with respect to a plane of the bed.

2. The plate heat exchanger according to claim 1, wherein the bed and the inner edge of the flange defining the wall surface together form-fittingly engage the bottom edge and the trough edge of the plate at the end face.

3. The plate heat exchanger according to claim 1, wherein the base plate is configured as an integral moulded part with the flange.

4. The plate heat exchanger according to claim 3, wherein the flange transitions at the inner edge directly from the flange surface into the bed, and wherein the flange terminates at the outer edge.

5. The plate heat exchanger according to claim 1, wherein the base plate engages at least one edge region of the trough bottom of the plate at the end face of the plate stack, the base plate including openings in the at least one edge region for fluid connections of the plate heat exchanger.

6. The plate heat exchanger according to claim 1, wherein the flange surface having the fastening holes defines a U-base of the U-shaped cross section of the flange that lies on the plane elevated with respect to the plane of the bed, and wherein the flange surface has a maximum extent at the fastening holes.

7. The plate heat exchanger according to claim 1, wherein the first fluid is water and the second fluid is oil.

8. The plate heat exchanger according to claim 1, wherein the shaped sheet material of the base plate is a shaped sheet metal.

9. The plate heat exchanger according to claim 1, wherein the bed has an elongated recess defining a through-opening in a central region of the base plate, and wherein the bed terminates at a marginal edge of the elongated recess in the central region of the base plate.

10. The plate heat exchanger according to claim 9, wherein the base plate further includes a plurality of flow openings disposed in the bed between the marginal edge of the elongated recess and the inner edge of the flange.

11. The plate heat exchanger according to claim 9, wherein the base plate is secured to the end face at a joined connection between the marginal edge of the elongated recess and at least the bottom edge of the plate at the end face of the plate stack.

12. The plate heat exchanger according to claim 1, wherein the flange surface extends along the plane in a shape of an elongated octagon with respect to a plan view of the base plate.

13. The plate heat exchanger according to claim 2, wherein the bed further includes a recess and at least one opening disposed at opposite ends between the recess and the inner edge of the flange.

* * * * *